US011400725B2

(12) United States Patent
Watanabe et al.

(10) Patent No.: US 11,400,725 B2
(45) Date of Patent: Aug. 2, 2022

(54) LIQUID EJECTION APPARATUS

(71) Applicant: Canon Kabushiki Kaisha, Tokyo (JP)

(72) Inventors: Keiji Watanabe, Kanagawa (JP); Kenji Tamamori, Kanagawa (JP); Takashi Sugawara, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 28 days.

(21) Appl. No.: 17/148,937

(22) Filed: Jan. 14, 2021

(65) Prior Publication Data

US 2021/0213744 A1 Jul. 15, 2021

(30) Foreign Application Priority Data

Jan. 15, 2020 (JP) ..... JP2020-004210

(51) Int. Cl.
*B41J 2/175* (2006.01)

(52) U.S. Cl.
CPC ..... *B41J 2/17523* (2013.01); *B41J 2/17553* (2013.01)

(58) Field of Classification Search
CPC .. B41J 2/17523; B41J 2/17553; B41J 2/1721; B41J 29/02; B41J 29/13
See application file for complete search history.

(56) References Cited

U.S. PATENT DOCUMENTS 6,062,670 A 5/2000 Iwata et al. ..... 347/23
2018/0345674 A1* 12/2018 Ochiai ..... B41J 2/1721

FOREIGN PATENT DOCUMENTS

JP 2018-202648 A 12/2018

OTHER PUBLICATIONS

U.S. Pat. No. 6,062,670 U.S. Appl. No. 17/147,799, filed Jan. 13, 2021 Title: Liquid Ejection Apparatus and Method of Attaching and Detaching Waste Liquid Container Inventors: Kenji Tamamori Kanagawa , (JP) Tetsushi Ishikawa Tokyo , (JP) Takashi Sugawara Kanagawa , (JP) Keiji Watanabe Kanagawa , (JP) Masafumi Morisue Tokyo , (JP) Seiichiro Yaginuma Kanagawa , (JP).
U.S. Appl. No. 17/148,967, filed Jan. 14, 2021 Title: Liquid Ejection Apparatus and Method for Detaching Waste Liquid Container Inventors: Takashi Sugawara Kanagawa , (JP) Kenji Tamamori Kanagawa, (JP) Keiji Watanabe Kanagawa , (JP).
(Continued)

*Primary Examiner* — Bradley W Thies
(74) *Attorney, Agent, or Firm* — Venable LLP

(57) ABSTRACT

A liquid ejection apparatus that prevents a user's hand from becoming dirty when attaching and detaching a liquid holding container, the liquid ejection apparatus includes a space portion that is open on a side surface of a housing, a liquid holding container that is detachably mounted to the space portion and includes an introduction port for introducing liquid to an inside thereof, on an upper surface, and a discharge portion that is provided at a position facing the introduction port inside the space portion in a state in which the liquid holding container mounted and includes a discharge port for discharging the liquid to the inside of the liquid holding container, in which the discharge portion is configured such that at least the discharge port is movable.

14 Claims, 6 Drawing Sheets

(56) References Cited

OTHER PUBLICATIONS

U.S. Appl. No. 17/147,809, filed Jan. 13, 2021 Title: Liquid Ejection Apparatus and Waste Liquid Container Inventors: Keiji Watanabe Kanagawa , (JP) Kenji Tamamori Kanagawa , (JP) Takashi Sugawara Kanagawa , (JP).
U.S. Appl. No. 17/161,585, filed Jan. 28, 2021 Title: Liquid Ejection Apparatus and Liquid Collection Container Inventors: Tetsushi Ishikawa Tokyo , (JP) Seiichiro Yaginuma Kanagawa , (JP).
U.S. Appl. No. 17/147,799, filed Jan. 13, 2021.
U.S. Appl. No. 17/148,967, filed Jan. 14, 2021.
U.S. Appl. No. 17/147,809, filed Jan. 13, 2021.
U.S. Appl. No. 17/161,585, filed Jan. 28, 2021.

* cited by examiner

LIQUID EJECTION APPARATUS

BACKGROUND OF THE INVENTION

Field of the Invention

The present invention relates to a liquid ejection apparatus including a liquid holding container for storing and holding a liquid.

Description of the Related Art

As a liquid ejection apparatus that ejects a liquid such as ink from a liquid ejection head and records an image on a recording medium, there is an apparatus provided with a detachable waste liquid holding container that stores and holds unnecessary liquid (waste liquid) generated by a recovery operation of the liquid ejection head. Japanese Patent Application Laid-Open No. 2018-202648 discloses a liquid ejection apparatus including a discharge portion that discharges a waste liquid through a waste liquid introduction port formed on an upper surface of the waste liquid holding container in a mounting portion on which the waste liquid holding container is detachably mounted.

However, in the configuration disclosed in Japanese Patent Application Laid-Open No. 2018-202648, when attaching and detaching the waste liquid holding container, a user may accidentally touch the discharge port of the discharge portion, which may stain the user's hand.

SUMMARY OF THE INVENTION

According to the present invention, there is provided a liquid ejection apparatus including a space portion that is open on a side surface of a housing, a liquid holding container that is detachably mounted to the space portion and includes an introduction port for introducing liquid to an inside thereof, on an upper surface, and a discharge portion that is provided at a position facing the introduction port inside the space portion in a state in which the liquid holding container mounted and includes a discharge port for discharging the liquid to the inside of the liquid holding container, in which the discharge portion is configured such that at least the discharge port is movable.

Further features of the present invention will become apparent from the following description of exemplary embodiments with reference to the attached drawings.

DESCRIPTION OF THE EMBODIMENTS

An object of the present invention is to provide a liquid ejection apparatus that prevents a user's hand from becoming dirty when attaching and detaching a liquid holding container.

Hereinafter, embodiments of the present invention will be described with reference to the drawings.

First Embodiment

Figure 1A:
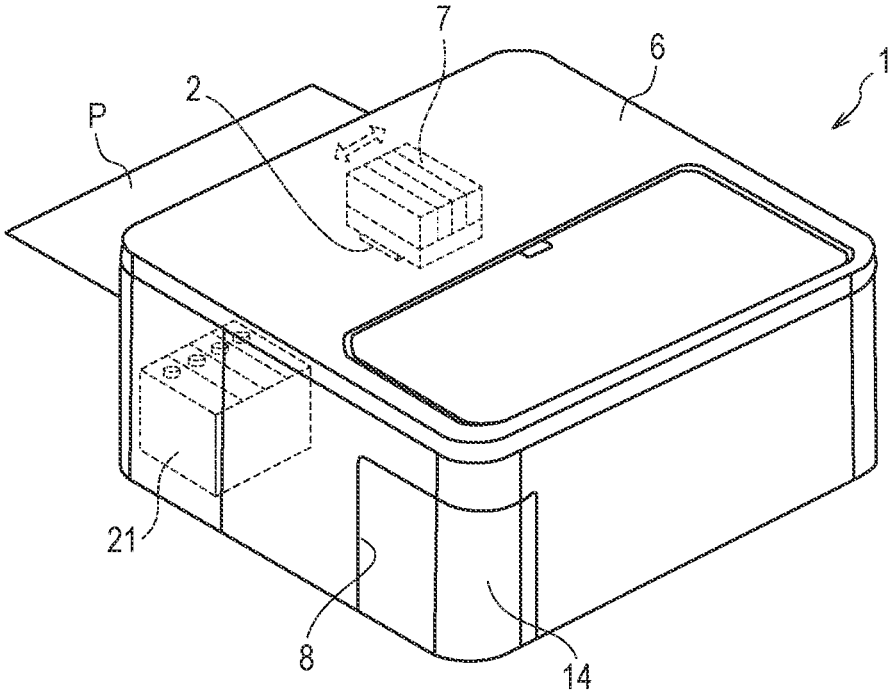
FIG. 1A is a perspective view of a liquid ejection apparatus according to a first embodiment.
Figure 1B:
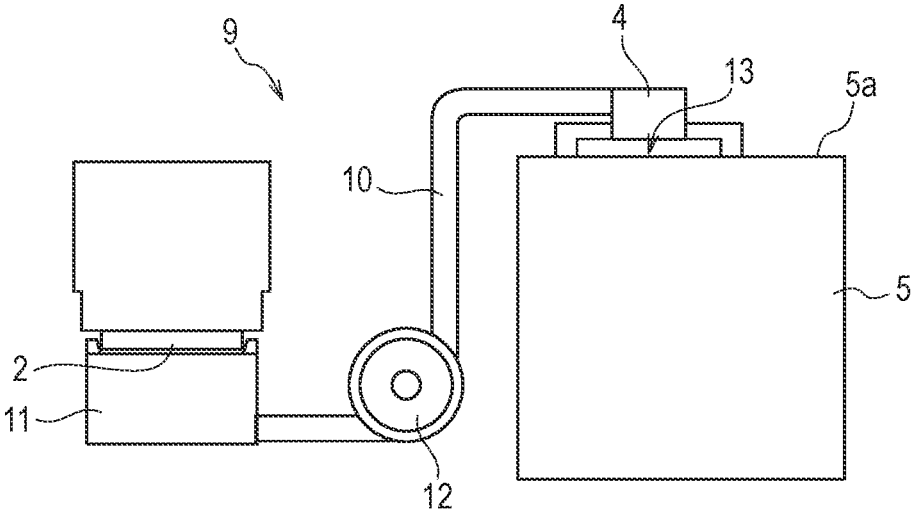
FIG. 1B is a schematic configuration diagram of a liquid ejection apparatus according to the first embodiment.

A configuration of the liquid ejection apparatus according to a first embodiment of the present invention will be described with reference to FIGS. 1A and 1B. FIG. 1A is a perspective view of the liquid ejection apparatus of the present embodiment, and FIG. 1B is a schematic view illustrating an internal configuration of the liquid ejection apparatus of the present embodiment.

The liquid ejection apparatus 1 is a serial type ink jet recording apparatus, and includes a rectangular parallelepiped housing 6, a carriage 7 provided in the housing 6 and a liquid ejection head 2 mounted on the carriage 7 to eject ink as a liquid. The carriage 7 is provided so as to be reciprocally movable in a direction intersecting a transport direction of paper P as a recording medium (refer to a white arrow indicated by a broken line in FIG. 1A). The liquid ejection head 2 is connected to a flexible liquid supply tube (not shown) via a liquid flow path formed inside the carriage 7, and the liquid supply tube is connected to an ink tank 21 that stores the ink supplied to the liquid ejection head 2. An image is recorded on the paper P by ejecting the ink from the ejection orifice provided in the liquid ejection head 2 during the reciprocating scanning of the carriage 7.

In addition, the liquid ejection apparatus 1 includes a maintenance unit 9 that performs a recovery operation of the liquid ejection head 2, and a waste liquid holding container (liquid holding container) 5 that can store ink (waste liquid) that is collected from the liquid ejection head 2 by the recovery operation and is no longer needed. The maintenance unit 9 includes a cap 11 that covers an ejection orifice surface (a surface on which the ejection orifice is formed) of the liquid ejection head 2 and a pump 12 formed of a waste liquid tube 10 connected to the cap 11 and a tube pump provided in the middle of the waste liquid tube 10. Further, the liquid ejection apparatus 1 is connected to the maintenance unit 9 via the waste liquid tube 10, and a discharge portion 4 including a discharge port (not shown) for discharging the waste liquid into the waste liquid holding container 5. In the recovery operation by the maintenance unit 9, in a state where the ejection orifice surface of the liquid ejection head 2 is covered with the cap 11, a suction operation is performed by the pump 12, so that the ink in the liquid ejection head 2 is sucked. The sucked ink (waste liquid) is discharged and collected to the inside of the waste liquid holding container 5 from the waste liquid tube 10 through the discharge port of the discharge portion 4.

The waste liquid holding container 5 is detachably mounted on the mounting portion 3 (refer to FIGS. 3A and 3B), which is a space portion opened on the side surface of the housing 6. On an upper surface 5*a* of the waste liquid holding container 5, a waste liquid introduction port 13 for introducing a liquid is formed inside the waste liquid holding container 5, and the discharge portion 4 is provided inside the mounting portion 3, and is disposed at a position facing the waste liquid introduction port 13 with the waste liquid holding container 5 mounted on the mounting portion 3. An opening portion 8 of the mounting portion 3 is provided with a cover 14 that covers the mounting portion 3 so as to be openable and closable. As will be described later, the cover 14 includes a moving mechanism for moving the discharge portion 4 between two positions in the vertical direction. In other words, the discharge portion 4 including the discharge port can move in the vertical direction in conjunction with the opening and closing of the cover 14. Here, "upper" and "lower" in the present specification mean up and down in a usage state of the liquid ejection apparatus 1. The configuration in which the waste liquid holding container 5 is detachable is particularly effective in the liquid ejection apparatus 1 equipped with a liquid continuous supply system capable of replenishing a tank provided in the liquid ejection apparatus 1 from a replenishing container such as a bottle. The reason for this is that, in such a liquid ejection apparatus 1, the amount of liquid used tends to be larger than before, along with this, the amount of waste liquid discharged increases, but by making the waste liquid holding container 5 detachable, it is possible to discharge a large amount of waste liquid by replacing the waste liquid holding container 5.

Figure 2A:
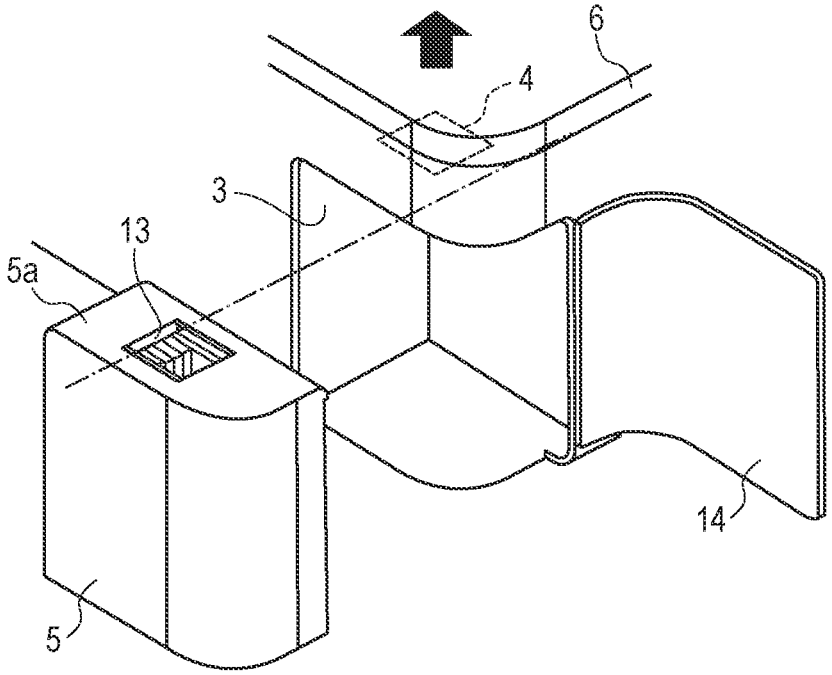
FIGS. 2A and 2B are perspective views of a waste liquid holding container and a mounting portion according to the first embodiment.
Figure 2B:
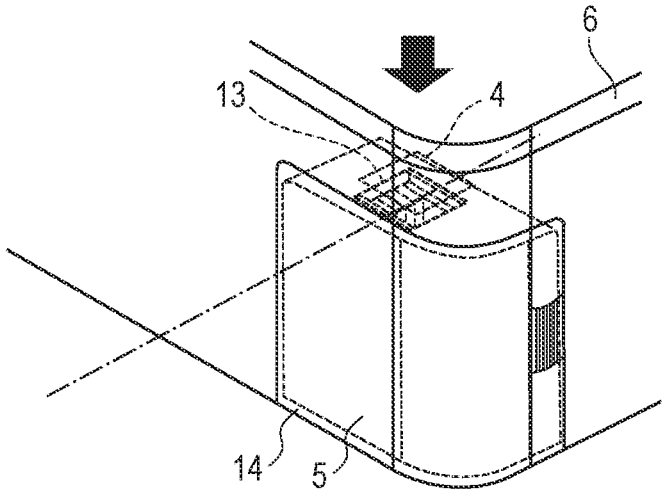

Here, with reference to FIGS. 2A and 2B, the movement operation of the discharge portion accompanying the opening and closing of the cover will be described. FIG. 2A is a perspective view illustrating a state in which the waste liquid holding container is detached from the mounting portion, and FIG. 2B is a perspective view illustrating a state in which the waste liquid holding container is mounted in the mounting portion.

As illustrated in FIG. 2A, in a state where the cover 14 is opened and the waste liquid holding container 5 is detached from the mounting portion 3, the discharge portion 4 is located at a retracted position (first position) above a height position of the waste liquid introduction port 13 formed on the upper surface of the waste liquid holding container 5. From this state, when the waste liquid holding container 5 is mounted to the mounting portion 3 and the cover 14 is closed, as illustrated in FIG. 2B, the discharge portion 4 can be lowered to a connection position (second position) connected to the waste liquid introduction port 13 in conjunction with the closing of the cover 14. Then, when the cover 14 is opened and the waste liquid holding container 5 is detached from the mounting portion 3, as illustrated in FIG. 2A again, the discharge portion 4 can be raised from the connection position to the retracted position in conjunction with the opening of the cover 14. The mechanism for moving the discharge portion 4 up and down in conjunction with the opening and closing of the cover 14 is not particularly limited, and a known mechanism can be used. For example, a sensor that detects the opening and closing of the cover 14 to operate the drive mechanism (for example, a motor) of the discharge portion 4, or a device that mechanically connects the cover 14 and the discharge portion 4 via an elastic member such as a spring can be used.

Figure 3A:
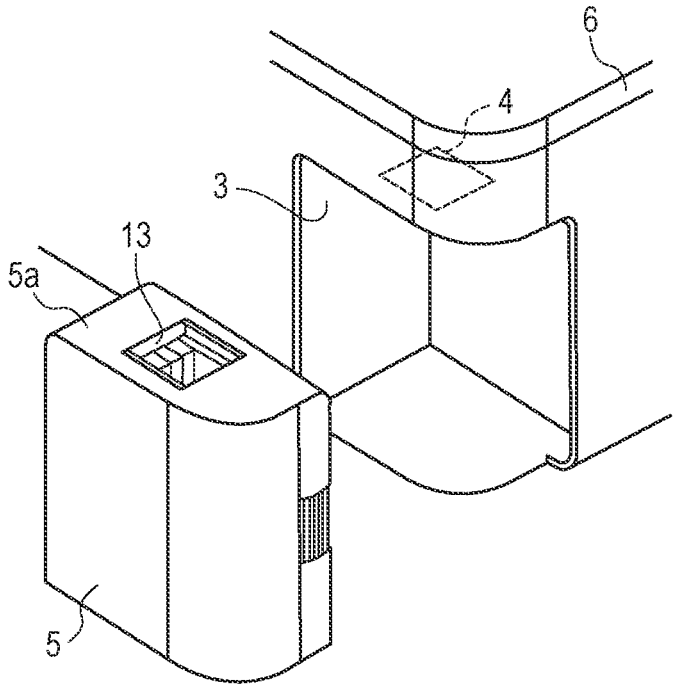
FIGS. 3A and 3B are perspective views of a waste liquid holding container and a mounting portion in the related art.
Figure 3B:
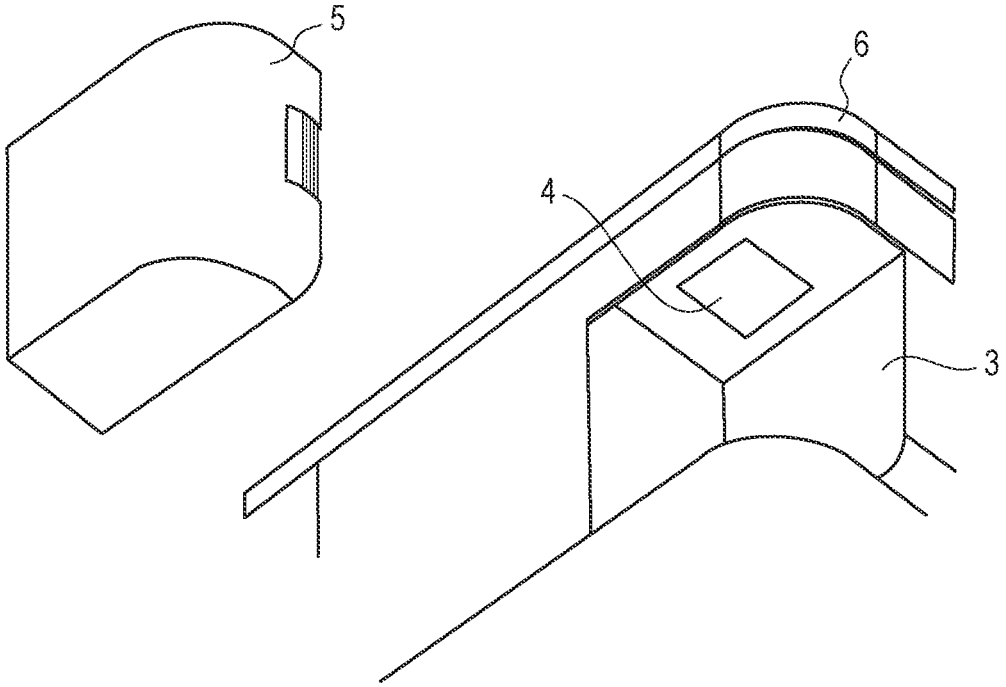

In the liquid ejection apparatus in the related art, as illustrated in FIGS. 3A and 3B, the discharge portion 4 is in the connection position with the mounting portion 3 open, and is not movable in the vertical direction. Therefore, when attaching and detaching the waste liquid holding container 5, a user may accidentally touch the discharge port of the discharge portion 4, which may stain the user's hand.

On the other hand, in the present embodiment, as described above, the discharge portion 4 is in the connection position when the cover 14 is closed, but when the cover 14 is opened, it can move to a retracted position above the connection position in conjunction with it. Therefore, it becomes difficult for the user to touch the discharge port of the discharge portion 4 when attaching and detaching the waste liquid holding container 5, and it is possible to prevent the user's hand from becoming dirty.

Second Embodiment

Figure 4A:
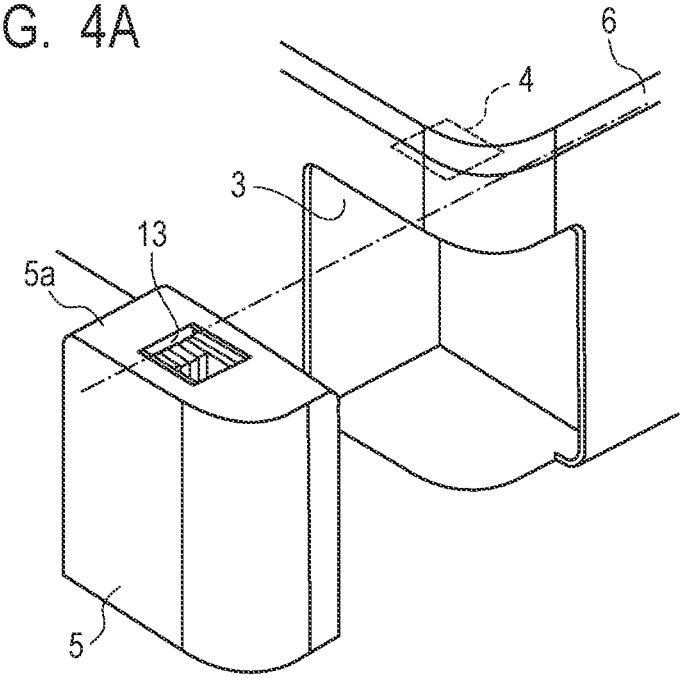
FIGS. 4A, 4B and 4C are perspective views of a waste liquid holding container and a mounting portion according to a second embodiment.
Figure 4B:
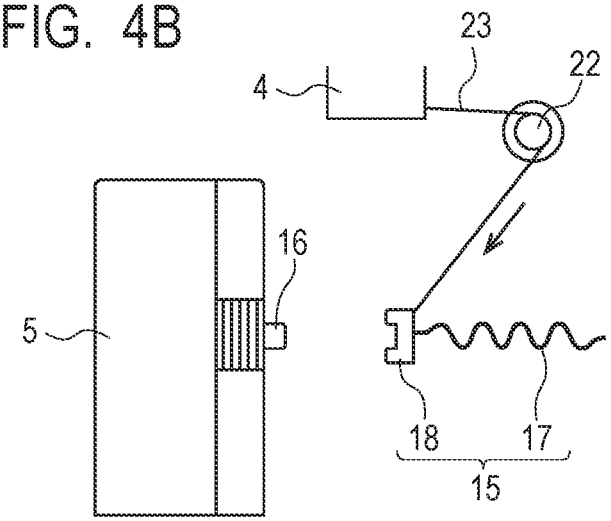
Figure 4C:
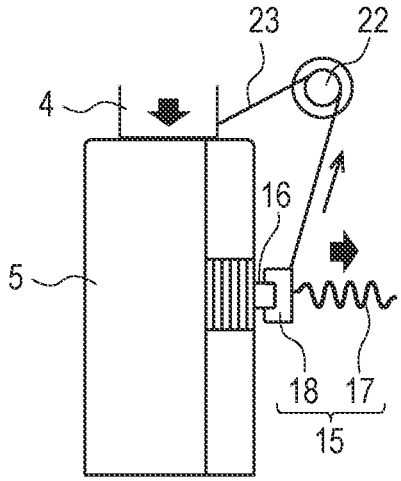

A configuration of the liquid ejection apparatus according to a second embodiment of the present invention will be described with reference to FIGS. 4A to 4C. FIGS. 4A and 4B are a perspective view and a schematic configuration diagram illustrating a state in which the waste liquid holding container is detached from the mounting portion in the present embodiment, respectively, and FIG. 4C is a schematic configuration diagram illustrating a state in which the waste liquid holding container is mounted on the mounting portion in the present embodiment. Hereinafter, the same configurations as those of the first embodiment will be described by adding the same reference numerals to the drawings and omitting the description thereof, and only the configurations different from those of the first embodiment will be described.

In the first embodiment, the cover 14 is provided as the moving mechanism of the discharge portion 4; however, in the present embodiment, instead the cover 14, a switch portion 15 is provided inside the mounting portion 3, and a convex pressing portion 16 is provided on the outer surface of the waste liquid holding container 5 correspondingly. The switch portion 15 includes an elastic member 17 and a concave pressed portion 18 provided at a tip end of the elastic member 17, and the pressed portion 18 is connected to the discharge portion 4 via a wire 23 wound around a pulley 22.

In a state where the waste liquid holding container 5 is not mounted on the mounting portion 3, the pressing portion 16 does not press the switch portion 15. Therefore, the pressed portion 18 of the switch portion 15 is urged toward the outside of the mounting portion 3 by the elastic member 17, and the urging force is transmitted to the discharge portion 4 through the wire 23. As a result, the discharge portion 4 is held in the retracted position (refer to FIG. 4B) above the connection position. Then, when the waste liquid holding container 5 is mounted on the mounting portion 3, the pressing portion 16 presses the pressed portion 18, and therefore, the urging force of the elastic member 17 is released, and the discharge portion 4 can be lowered from the retracted position to the connecting position (refer to FIG. 4C). As a result, the same effect as that of the first embodiment can be obtained in the present embodiment. The mechanism for moving the discharge portion 4 up and down in conjunction with the pressing of the switch portion 15 is not limited to the one using the wire 23 and the pulley 22 as illustrated in the drawings, and other known mechanisms can also be used. Further, the cover 14 similar to that of the first embodiment may be provided except that it does not function as a moving mechanism of the discharge portion 4.

Third Embodiment

Figure 5:
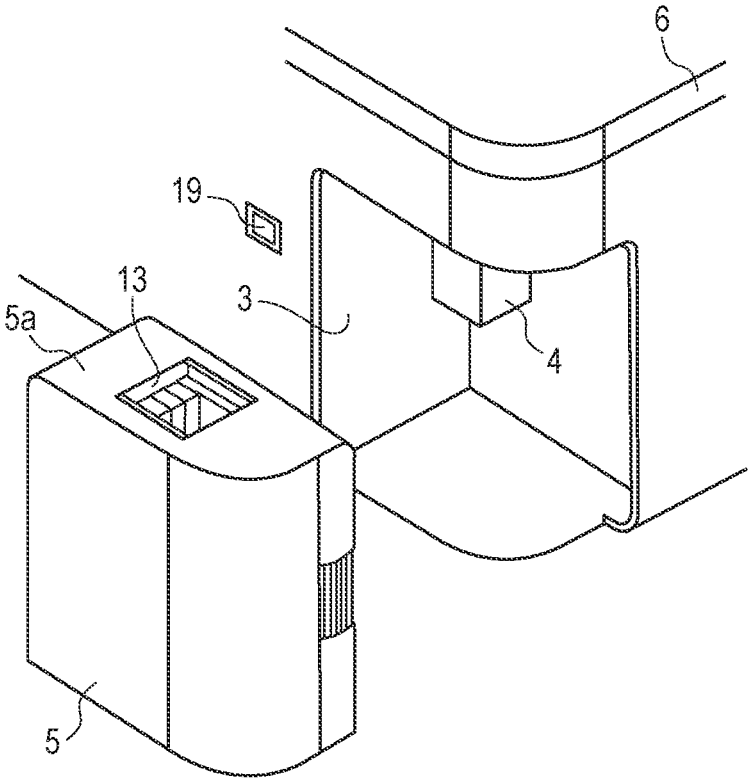
FIG. 5 is a perspective view of a waste liquid holding container and a mounting portion according to a third embodiment.

A configuration of the liquid ejection apparatus according to a third embodiment of the present invention will be described with reference to FIG. 5. FIG. 5 is a perspective view illustrating a state in which the waste liquid holding container is detached from the mounting portion in the present embodiment. Hereinafter, the same configurations as those of the above-described embodiment will be described by adding the same reference numerals to the drawings and omitting the description thereof, and only the configurations different from those of the above-described embodiment will be described.

The present embodiment is different from the above-described embodiment in that the discharge portion 4 is below the connection position with the mounting portion 3 open, along with this, the direction in which the discharge portion 4 moves when attaching and detaching the waste liquid holding container 5 is also different from the above-described embodiment. That is, the lower end of the discharge portion 4 is located sufficiently below the upper surface 5*a* of the waste liquid holding container 5 with the mounting portion 3 open, and as a result, it is in an exposed position (first position) exposed to the outside through the opening portion 8. Further, as a moving mechanism of the discharge portion 4, a button 19 is provided on the side surface of the housing 6 instead of the cover 14 of the first embodiment and the switch portion 15 and the pressing portion 16 of the second embodiment. The button 19 raises the discharge portion 4 from the exposed position to the connection position when pressed, and lowers the discharge portion 4 from the connection position to the exposed position when the pressure is released. The mechanism for moving the discharge portion 4 up and down in conjunction with the pressing of the button 19 is not particularly limited, and for example, similar to the second embodiment, a mechanism for transmitting the urging force of the elastic member to the discharge portion 4 through the wire can be used.

With such a configuration, in the present embodiment, since the discharge portion 4 can be easily seen in the state where the mounting portion 3 is open, it becomes difficult for the user to touch the discharge port of the discharge portion 4 when attaching and detaching the waste liquid holding container 5, and it is possible to prevent the user's hand from becoming dirty. In addition, even if the discharge portion 4 is in the exposed position with the mounting portion 3 open, when the user presses the button 19, the discharge portion 4 is raised to the connection position, and the discharge port can be connected to the waste liquid introduction port 13. Note that, even in the present embodiment, the cover 14 similar to that of the first embodiment may be provided except that it does not function as a moving mechanism of the discharge portion 4.

Fourth Embodiment

Figure 6A:
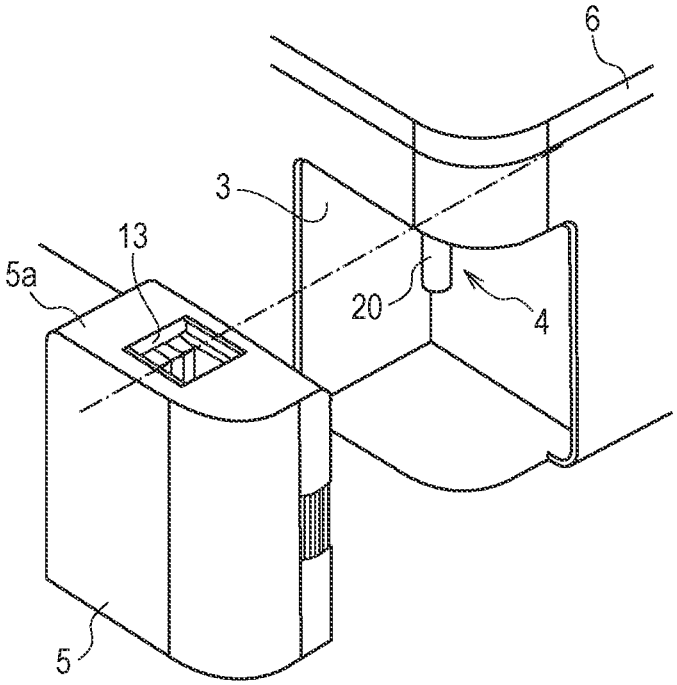
FIGS. 6A, 6B, 6C and 6D are perspective views of a waste liquid holding container and a mounting portion according to a fourth embodiment.
Figure 6B:
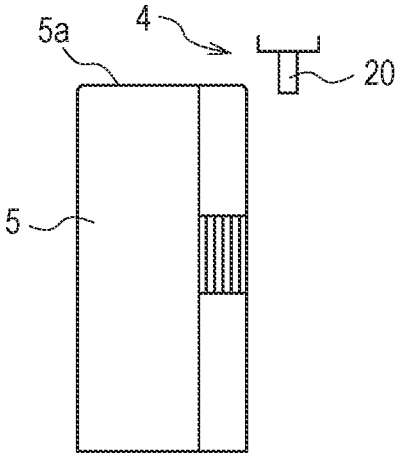
Figure 6C:
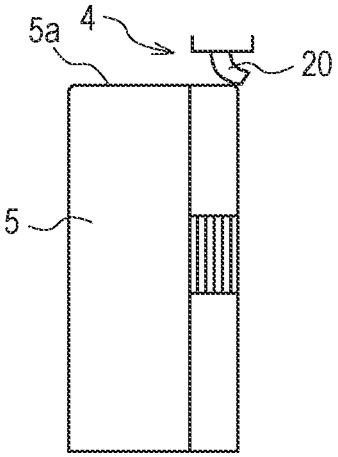
Figure 6D:
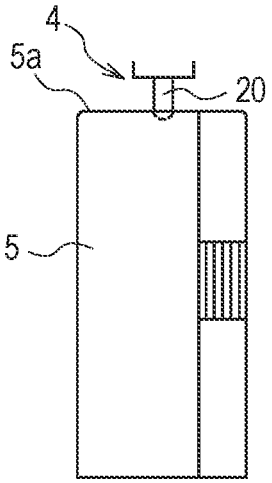

A configuration of the liquid ejection apparatus according to a fourth embodiment of the present invention will be described with reference to FIGS. 6A to 6D. FIG. 6A is a perspective view illustrating a state in which the waste liquid holding container is detached from the mounting portion in the present embodiment, and FIGS. 6B to 6D are schematic configuration diagrams illustrating a state in which the waste liquid holding container is mounted on the mounting portion in the present embodiment. Hereinafter, the same configurations as those of the above-described embodiment will be described by adding the same reference numerals to the drawings and omitting the description thereof, and only the configurations different from those of the above-described embodiment will be described.

The present embodiment is similar to the third embodiment in that the discharge portion 4 is exposed to the outside in a state where the mounting portion 3 is open, but is different from the third embodiment in that the discharge portion 4 is configured to be elastically deformable. That is, the discharge portion 4 includes a discharge nozzle 20 is formed of an elastic body protruding downward, and as illustrated in FIGS. 6B to 6D, the discharge nozzle 20 is elastically deformed in contact with the waste liquid holding container 5 when the waste liquid holding container 5 is mounted on the mounting portion 3. With such a configuration, also in the present embodiment, the discharge nozzle 20 becomes easy to see as in the third embodiment, so that it is possible to prevent the user's hand from becoming dirty. In addition, even if the tip end of the discharge nozzle 20 reaches below the upper surface 5*a* of the waste liquid holding container 5, due to the elastic deformation of the discharge nozzle 20, the discharge port of the discharge nozzle 20 can be moved and connected to the waste liquid introduction port 13. Note that, even in the present embodiment, the cover 14 similar to that of the first embodiment may be provided except that it does not function as a moving mechanism of the discharge portion 4.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-004210, filed Jan. 15, 2020, which is hereby incorporated by reference herein in its entirety.

What is claimed is:

1. A liquid ejection apparatus comprising:

a space portion that is open on a side surface of a housing;

a liquid holding container that is detachably mounted to the space portion and includes an introduction port for introducing liquid to an inside thereof, on an upper surface; and a discharge portion that is provided at a position facing the introduction port inside the space portion in a state in which the liquid holding container mounted and includes a discharge port for discharging the liquid to the inside of the liquid holding container, wherein the discharge portion is configured such that at least the discharge port is movable.

2. The liquid ejection apparatus according to claim 1, wherein the discharge portion is movable in a vertical direction between a first position and a second position for discharging the liquid to the inside of the liquid holding container.

3. The liquid ejection apparatus according to claim 2, wherein the discharge portion is at the first position in a state in which the space portion is open, and the first position is above the second position.

4. The liquid ejection apparatus according to claim 3, further comprising:

a moving mechanism for moving the discharge portion between the first position and the second position.

5. The liquid ejection apparatus according to claim 4, further comprising:

a cover that covers the space portion so as to be openable and closable, wherein the moving mechanism moves the discharge portion in conjunction with the opening and closing of the cover.

6. The liquid ejection apparatus according to claim 5, wherein, the cover lowers the discharge portion from the first position to the second position when the space portion is closed, and, raises the discharge portion from the second position to the first position when the space portion is open.

7. The liquid ejection apparatus according to claim 4, wherein the moving mechanism includes a switch provided inside the space portion and a pressing portion provided in the liquid holding container and pressing the switch when the liquid holding container is mounted in the space portion.

8. The liquid ejection apparatus according to claim 7, wherein the switch lowers the discharge portion from the first position to the second position when the switch is pressed by the pressing portion, and raises the discharge portion from the second position to the first position when the pressing by the pressing portion is released.

9. The liquid ejection apparatus according to claim 2, wherein the discharge portion is at the first position in a state in which the space portion is open, and the first position is below the second position.

10. The liquid ejection apparatus according to claim 9, further comprising:

a moving mechanism for moving the discharge portion between the first position and the second position.

11. The liquid ejection apparatus according to claim 10, wherein the moving mechanism includes a button that is provided in the housing and that raises the discharge portion from the first position to the second position when the button is pressed by the pressing portion, and lowers the discharge portion from the second position to the first position when the pressing is released.

12. The liquid ejection apparatus according to claim 9, wherein a lower end of the discharge portion is located below the upper surface of the liquid holding container in a state of being mounted in the space portion.

13. The liquid ejection apparatus according to claim 1, wherein the discharge portion has a nozzle formed of an elastic body protruding downward and including the discharge port.

14. The liquid ejection apparatus according to claim 13, wherein a lower end of the nozzle is located below the upper surface of the liquid holding container in a state of being mounted in the space portion.

* * * * *